US010096313B1

(12) United States Patent
terMeulen et al.

(10) Patent No.: US 10,096,313 B1
(45) Date of Patent: Oct. 9, 2018

(54) PARALLEL ACTIVE NOISE REDUCTION (ANR) AND HEAR-THROUGH SIGNAL FLOW PATHS IN ACOUSTIC DEVICES

(71) Applicant: Bose Corporation, Framingham, MA (US)

(72) Inventors: Ryan terMeulen, Watertown, MA (US); John Allen Rule, Berlin, MA (US); Dale McElhone, Marlborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/710,354

(22) Filed: Sep. 20, 2017

(51) Int. Cl.
*G10K 11/178* (2006.01)
*H04R 1/10* (2006.01)
*H04R 3/00* (2006.01)

(52) U.S. Cl.
CPC ..... *G10K 11/178* (2013.01); *H04R 1/1083* (2013.01); *H04R 3/005* (2013.01); *G10K 2210/1081* (2013.01); *G10K 2210/3056* (2013.01)

(58) Field of Classification Search
CPC .. H04R 1/1083; H04R 3/005; H04R 2410/05; G10K 11/178; G10K 2210/3028; G10K 11/175; G10K 2210/3011; G10K 2210/30231
See application file for complete search history.

(56) References Cited

U.S. PATENT DOCUMENTS 8,073,150 B2 12/2011 Joho et al.
8,073,151 B2 12/2011 Joho et al.
8,155,334 B2 4/2012 Joho et al.
8,798,283 B2 8/2014 Gauger, Jr. et al.
9,082,388 B2 7/2015 Annunziato et al.
9,792,893 B1 * 10/2017 Gauger, Jr. ..... G10K 11/1788
2006/0153394 A1 7/2006 Beasley
(Continued)

FOREIGN PATENT DOCUMENTS

EP 2 217 005 8/2010
EP 2 418 642 2/2012
EP 3 163 902 5/2017

OTHER PUBLICATIONS

International Search Report and Written Opinion; PCT/US2017/062365; dated Jun. 14, 2018; 16 pages.

*Primary Examiner* — Mohammad Islam
(74) *Attorney, Agent, or Firm* — Fish & Richardson P.C.

(57) ABSTRACT

Technology described in this document can be embodied in a method that includes receiving an input signal captured by one or more sensors associated with an active noise reduction (ANR) device, processing the input signal using a first filter disposed in an ANR signal flow path to generate a first signal for an acoustic transducer of the ANR device, and processing the input signal in a pass-through signal flow path disposed in parallel with the ANR signal flow path to generate a second signal for the acoustic transducer. The pass-through signal flow path is configured to allow at least a portion of the input signal to pass through to the acoustic transducer in accordance with a variable gain associated with the pass-through signal flow path. The method also includes generating an output signal for the acoustic transducer based on combining the first signal with the second signal.

25 Claims, 6 Drawing Sheets

(56) References Cited

U.S. PATENT DOCUMENTS

2010/0272276 A1* 10/2010 Carreras ..... G10K 11/178
381/71.6
2010/0296668 A1* 11/2010 Lee ..... G10K 11/1784
381/94.7
2011/0116536 A1* 5/2011 Tsuie ..... H04L 25/03038
375/232
2011/0293103 A1* 12/2011 Park ..... G10K 11/1782
381/57
2014/0126734 A1* 5/2014 Gauger, Jr. ..... H04R 3/002
381/71.6
2014/0126736 A1* 5/2014 Gauger, Jr. ..... G10K 11/178
381/71.6
2014/0126756 A1* 5/2014 Gauger, Jr. ..... A61F 11/14
381/309
2015/0190284 A1* 7/2015 Censo ..... G10K 11/175
128/867
2017/0318374 A1* 11/2017 Dolenc ..... H04R 1/1041
2017/0318377 A1* 11/2017 Lott ..... H04R 1/1041

* cited by examiner

PARALLEL ACTIVE NOISE REDUCTION (ANR) AND HEAR-THROUGH SIGNAL FLOW PATHS IN ACOUSTIC DEVICES

TECHNICAL FIELD

This disclosure generally relates to active noise reduction (ANR) devices that also allows hear-through functionality to reduce isolation effects.

BACKGROUND

Acoustic devices such as headphones can include active noise reduction (ANR) capabilities that block at least portions of ambient noise from reaching the ear of a user. Therefore, ANR devices create an acoustic isolation effect, which isolates the user, at least in part, from the environment. To mitigate the effect of such isolation, some acoustic devices can include a hear-through mode, in which the noise reduction is turned down for a period of time and the ambient sounds are allowed to be passed to the user's ears. Examples of such acoustic devices can be found in U.S. Pat. No. 8,155,334 and U.S. Pat. No. 8,798,283, the entire contents of which are incorporated herein by reference.

SUMMARY

In general, in one aspect, this document features a method that includes receiving an input signal captured by one or more sensors associated with an active noise reduction (ANR) device, processing the input signal using a first filter disposed in an ANR signal flow path to generate a first signal for an acoustic transducer of the ANR device, and processing the input signal in a pass-through signal flow path disposed in parallel with the ANR signal flow path to generate a second signal for the acoustic transducer. The pass-through signal flow path is configured to allow at least a portion of the input signal to pass through to the acoustic transducer in accordance with a variable gain associated with the pass-through signal flow path. The method also includes generating an output signal for the acoustic transducer based on combining the first signal with the second signal.

In another aspect, this document features an active noise reduction (ANR) device that includes one or more sensors configured to generate an input signal indicative of an external environment of the ANR device, and an acoustic transducer configured to generate output audio. The device also includes a first filter disposed in an ANR signal flow path of the ANR device, wherein the first filter is configured to process the input signal to generate a first signal for an acoustic transducer of the ANR device. The device further includes a pass-through signal flow path disposed in parallel with the ANR signal flow path, the pass-through signal flow path configured to generate a second signal for the acoustic transducer. The pass-through signal flow path is configured to allow at least a portion of the input signal to pass through to the acoustic transducer in accordance with a variable gain associated with the pass-through signal flow path, and the acoustic transducer is driven by an output signal that is a combination of the first signal and the second signal.

In another aspect, this document features or more machine-readable storage devices having encoded thereon computer readable instructions for causing one or more processing devices to perform various operations. The operations include receiving an input signal captured by one or more sensors associated with an active noise reduction (ANR) device, processing the input signal using a first filter disposed in an ANR signal flow path to generate a first signal for an acoustic transducer of the ANR device, and processing the input signal in a pass-through signal flow path in parallel with the ANR signal flow path to generate a second signal for the acoustic transducer. The pass-through signal flow path is configured to allow at least a portion of the input signal to pass through to the acoustic transducer in accordance with a variable gain associated with the pass-through signal flow path. The operations also include generating an output signal for the acoustic transducer based on combining the first signal with the second signal.

Implementations of the above aspects can include one or more of the following. The one or more sensors can include a feedforward microphone of the ANR device. The ANR filter can include a filter bank that includes a plurality of selectable digital filters, each digital filter in the filter bank corresponding to a value of the variable gain associated with the pass-through signal flow path. The pass-through signal flow path can include a second filter. The coefficients of each of the first filter and the second filter can be substantially fixed. A set of coefficients of the first filter can be determined substantially independently of a set of coefficients of the second filter. A first latency associated with the ANR signal flow path can be substantially different from a second latency associated with the pass-through signal flow path. A user-input indicative of the variable gain associated with the pass-through signal path can be received, and a variable gain amplifier (VGA) disposed in the pass-through signal path can be adjusted in accordance with the user-input. Coefficients of at least one of the first filter and a second filter disposed in the pass-through signal flow path may also be selected in accordance with the user-input. The coefficients of the at least one of the first filter and the second filter may be determined in accordance with a target spectral characteristic of the corresponding filter. The target spectral characteristic can be spectral flatness. The ANR signal flow path and pass-through signal flow path can be disposed in a feedforward signal flow path for the ANR device.

Various implementations described herein may provide one or more of the following advantages. Providing a variable gain hear-through or pass-through signal flow path in parallel to an ANR signal flow path allows for implementing noise reduction functionalities while, in some instances, concurrently allowing ambient sounds to pass through to a degree as per user-preference. This in turn allows for implementing a "volume control"—either as discrete steps, or substantially continuous—on the amount of ambient noise the user prefers to hear. In some cases, this may improve the user-experience associated with corresponding acoustic devices (e.g., headphones) by making such devices more usable in various different types of environments. In some cases, the performance of the acoustic devices may be further improved by using filters that are invariant with respect to the amount of noise the user prefers to receive via the pass-through signal flow path. For example, separate filter selection/computation may be avoided for different gain settings of the pass-through signal path, which in turn may reduce memory and/or computing power requirements. This advantage could be significant in some cases, for example, in small form-factor devices with limited real-estate and computing resources. In some cases, the order of the filters in each of the parallel signal flow paths can be smaller as compared to that of the filters that are computed/selected for different gain settings of the pass-through signal path.

Two or more of the features described in this disclosure, including those described in this summary section, may be combined to form implementations not specifically described herein. The details of one or more implementations are set forth in the accompanying drawings and the description below. Other features, objects, and advantages will be apparent from the description and drawings, and from the claims.

DETAILED DESCRIPTION

This document describes technology that allows the use of Active Noise Reduction (ANR) in acoustic devices while concurrently allowing a user to control the amount of ambient noise that the user would like to hear. Active Noise Reduction (ANR) devices such as ANR headphones are used for providing potentially immersive listening experiences by reducing effects of ambient noise and sounds. However, by blocking out the effect of the ambient noise, an ANR device may create an acoustic isolation from the environment, which may not be desirable in some conditions. For example, a user waiting at an airport may want to be aware of flight announcements while using ANR headphones. In another example, while using an ANR headphone to cancel out the noise of an airplane in flight, a user may wish to be able to communicate with a flight attendant without having to take off the headphone.

Some headphones offer a feature commonly called "talk-through" or "monitor," in which external microphones are used to detect external sounds that the user might want to hear. For example, the external microphones, upon detecting sounds in the voice-band or some other frequency band of interest, can allow signals in the corresponding frequency bands to be piped through the headphones. Some other headphones allow multi-mode operations, wherein in a "hear-through" mode, the ANR functionality may be switched off or at least reduced, over at least a range of frequencies, to allow relatively wide-band ambient sounds to reach the user. However, in some cases, a user may want to maintain ANR functionalities, while still being able to be aware of the ambient sounds. In addition, the user may want to control the amount of noise and ambient sounds that pass through the ANR device.

The technology described herein allows for the implementation of an ANR signal flow path in parallel with a pass-through signal flow path, wherein the gain of the pass-through signal path is controllable by the user. This may allow for implementing ANR devices where the amount of ambient noise passed through can be adjusted based on user-input (e.g., either in discrete steps, or substantially continuously) without having to turn-off or reduce the ANR provided by the device. In some cases, this may improve the overall user experience, for example, by avoiding any audible artifacts associated with switching between ANR and pass-through modes, and/or putting the user in control of the amount of ambient noise that the user wishes to hear. This in turn can make ANR devices more usable in various different applications and environments, particularly in those where a substantially continuous balance between ANR and pass-through functionalities is desirable.

Figure 1:
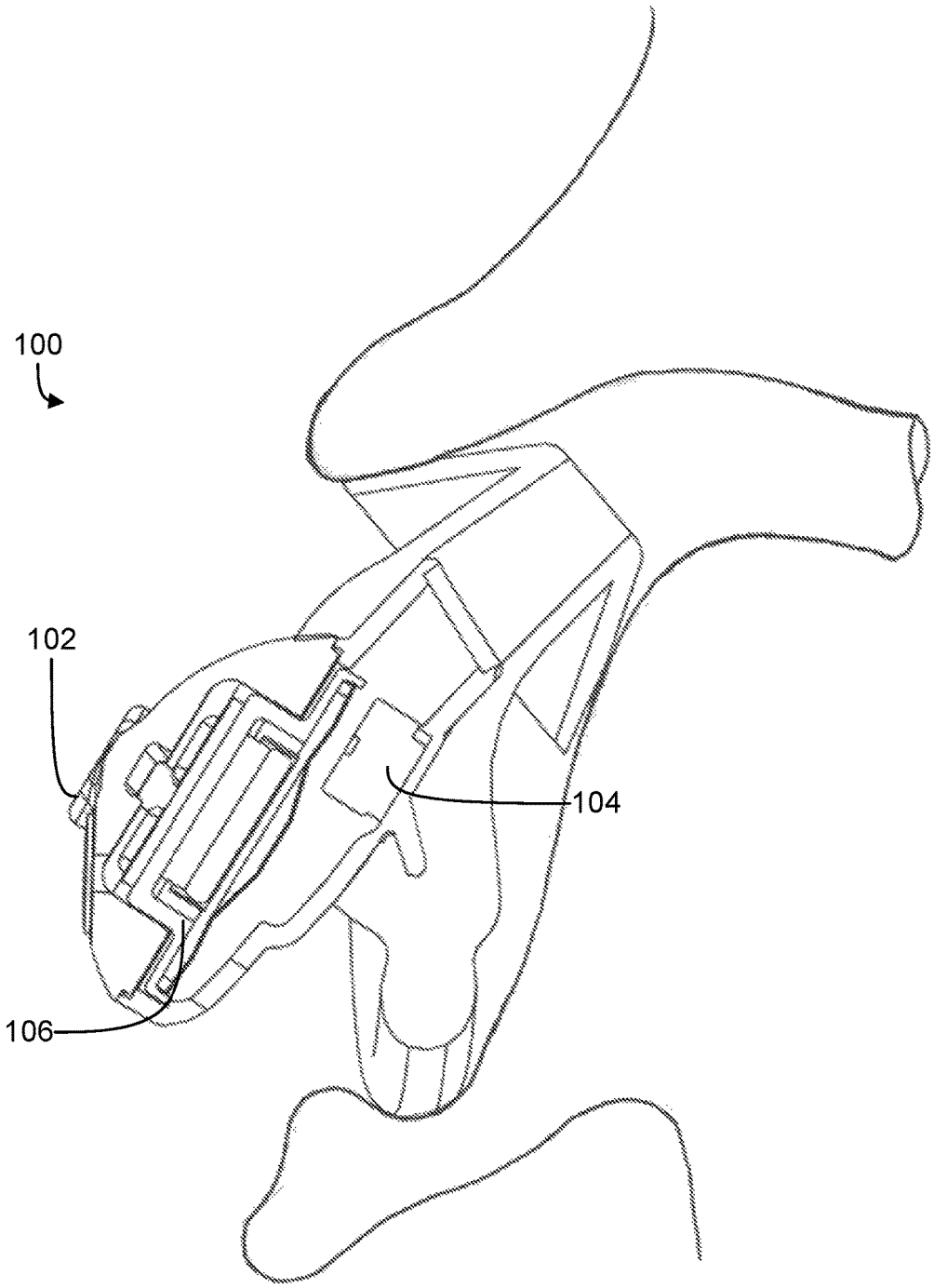
FIG. 1 shows an example of an in-the-ear active noise reduction (ANR) headphone.

An active noise reduction (ANR) device can include a configurable digital signal processor (DSP), which can be used for implementing various signal flow topologies and filter configurations. Examples of such DSPs are described in U.S. Pat. Nos. 8,073,150 and 8,073,151, which are incorporated herein by reference in their entirety. U.S. Pat. No. 9,082,388, also incorporated herein by reference in its entirety, describes an acoustic implementation of an in-ear active noise reducing (ANR) headphone, as shown in FIG. 1. This headphone 100 includes a feedforward microphone 102, a feedback microphone 104, an output transducer 106 (which may also be referred to as an electroacoustic transducer or acoustic transducer), and a noise reduction circuit (not shown) coupled to both microphones and the output transducer to provide anti-noise signals to the output transducer based on the signals detected at both microphones. An additional input (not shown in FIG. 1) to the circuit provides additional audio signals, such as music or communication signals, for playback over the output transducer 106 independently of the noise reduction signals.

The term headphone, which is interchangeably used herein with the term headset, includes various types of personal acoustic devices such as in-ear, around-ear or over-the-ear headsets, earphones, and hearing aids. The headsets or headphones can include an earbud or ear cup for each ear. The earbuds or ear cups may be physically tethered to each other, for example, by a cord, an over-the-head bridge or headband, or a behind-the-head retaining structure. In some implementations, the earbuds or ear cups of a headphone may be connected to one another via a wireless link.

Figure 2A:
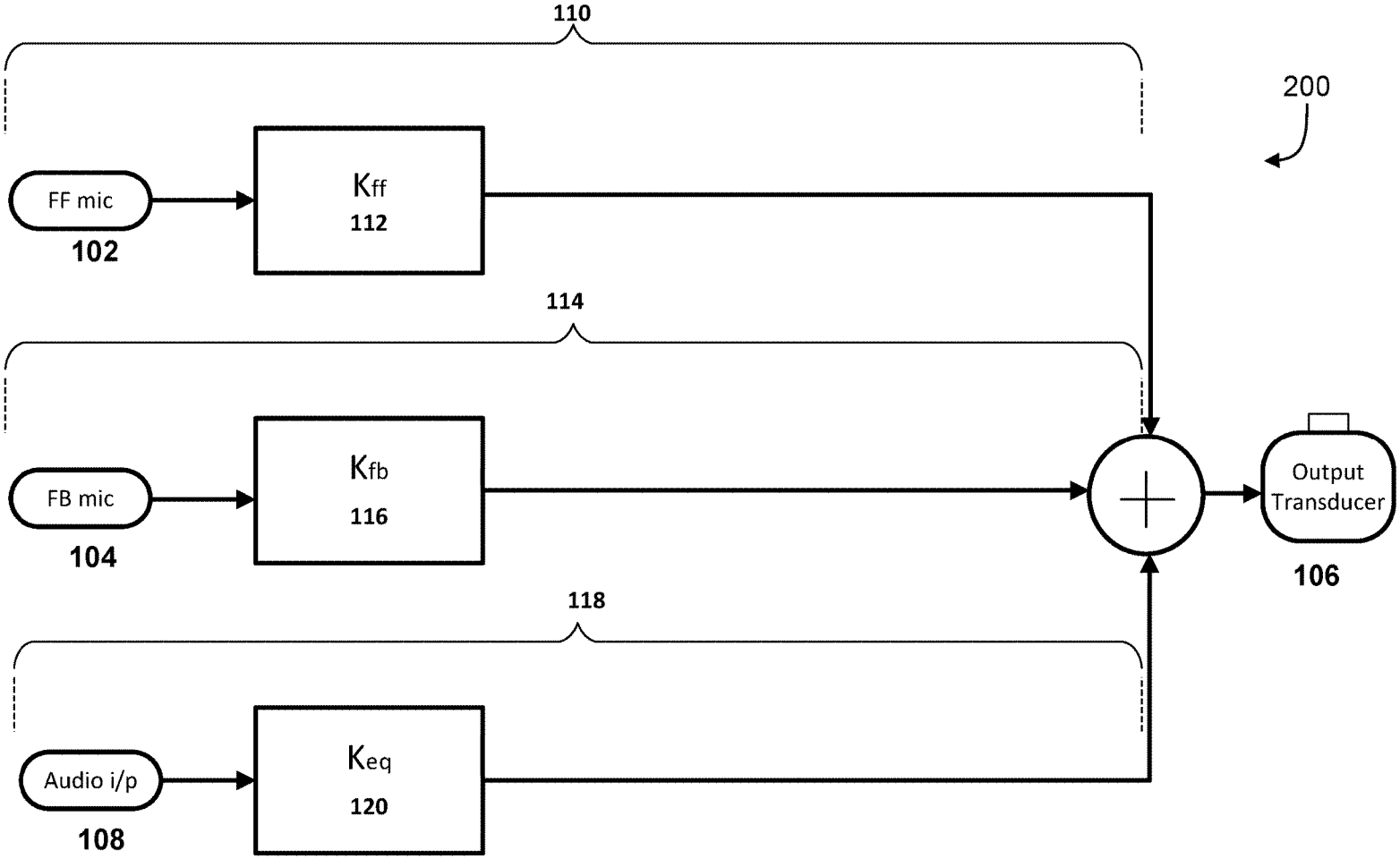
FIG. 2A is a block diagram of an example configuration in of an ANR device.

Various signal flow topologies can be implemented in an ANR device to enable functionalities such as audio equalization, feedback noise cancellation, feedforward noise cancellation, etc. For example, as shown in the example block diagram of an ANR device 200 in FIG. 2A, the signal flow topologies can include a feedforward signal flow path 110 that drives the output transducer 106 to generate an anti-noise signal (using, for example, a feedforward compensator 112) to reduce the effects of a noise signal picked up by the feedforward microphone 102. In another example, the signal flow topologies can include a feedback signal flow path 114 that drives the output transducer 106 to generate an anti-noise signal (using, for example, a feedback compensator 116) to reduce the effects of a noise signal picked up by the feedback microphone 104. The signal flow topologies can also include an audio path 118 that includes circuitry (e.g., equalizer 120) for processing input audio signals 108 such as music or communication signals, for playback over the output transducer 106.

Figure 2B:
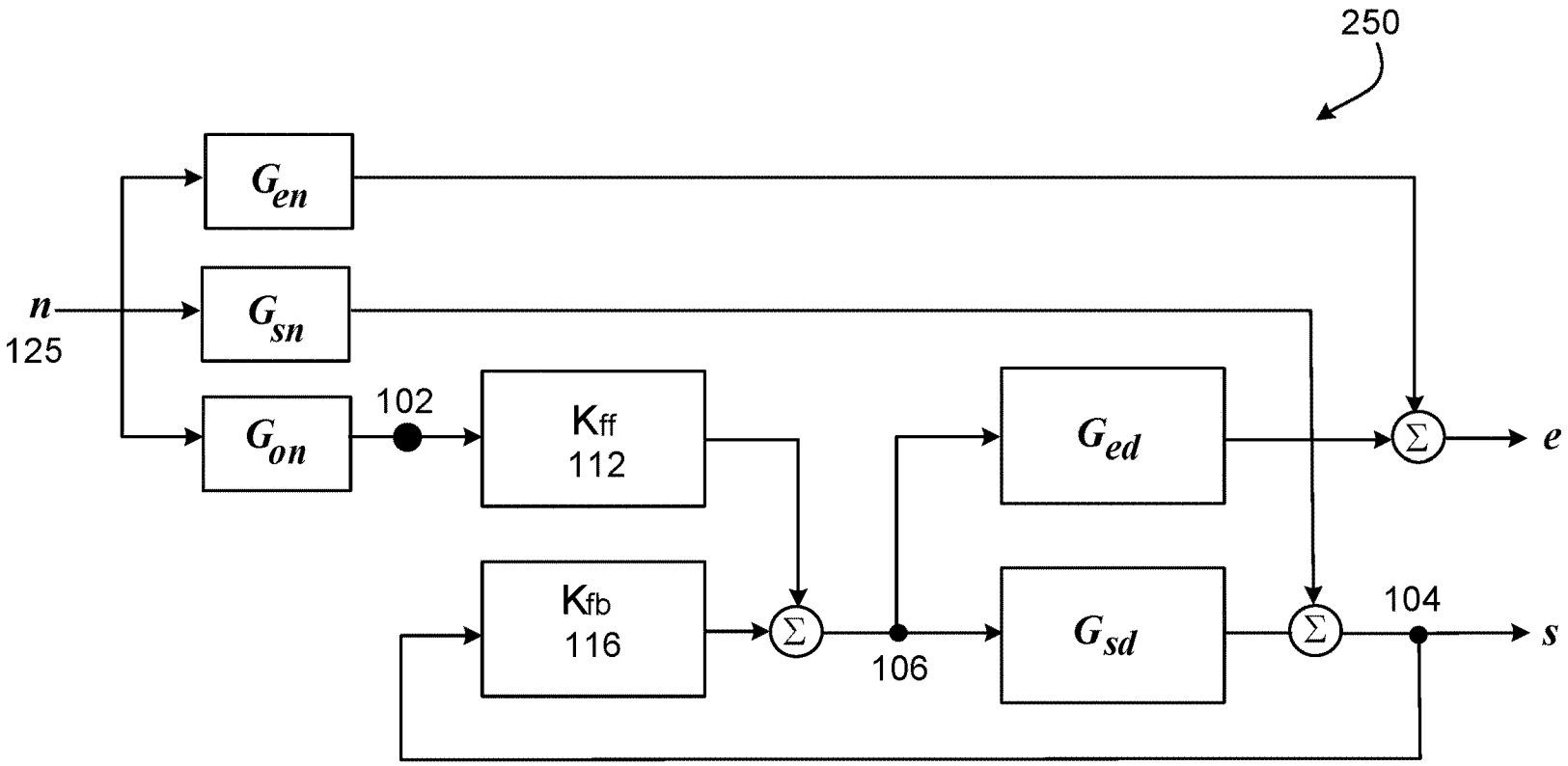
FIG. 2B is a block diagram of another example configuration of an ANR device.

Other configurations of signal flow topologies are also possible. FIG. 2B is a block diagram of another example configuration 250 of an ANR device. For the sake of brevity, the example configuration 250 does not show an audio path akin to the audio path 118 shown in FIG. 2A. The configuration 250 also shows the transfer function $G_{sd}$ that represents the acoustic path between the acoustic transducer 106 and the feedback microphone 104 (which may also be referred to as the system microphone or sensor s). The transfer function $G_{ed}$ represents the acoustic path between the driver d (or the acoustic transducer 106) and the microphone e disposed proximate to the ear of the user. The microphone e measures the noise at the ear of the user. The microphone may be inserted in the ear canal of a user during the system design process, but may not be a part of the ANR device itself. The noise n represents an input to the configuration 250. The transfer function between the noise source 125 and the feedforward microphone 102 is represented by $G_{on}$, such that the noise, as captured by the feedforward microphone 102, is represented as $n \times G_{on}$. The transfer functions of the acoustic paths between (i) the noise source 125 and the feedback microphone 104, and (ii) the noise source and the ear e are represented as $G_{sn}$ and $G_{en}$, respectively.

The relationships between the various sensors or microphones, and the two sources of audio (the noise source 125 and the acoustic transducer 106) can therefore be expressed using the following equations:

$$d=K_{fb}s+K_{ff}o \tag{1}$$

$$s=G_{sd}d+G_{sn}n \tag{2}$$

$$e=G_{ed}d+G_{en}n \tag{3}$$

$$o=G_{on}n \tag{4}$$

Therefore, the ratio of noise measured at the feedback microphone 104 relative to the noise n is given by:

$$\frac{s}{n}=\frac{K_{ff}G_{sd}G_{on}+G_{sn}}{1-K_{fb}G_{sd}} \tag{5}$$

Similarly, the noise measured at the ear (e) relative to the disturbance noise n is given by:

$$\frac{e}{n}=G_{en}\left[1+G_{ed}\frac{\left(\frac{G_{sb}}{G_{en}}\right)K_{fb}+\left(\frac{G_{on}}{G_{en}}\right)K_{ff}}{1-K_{fb}G_{sd}}\right] \tag{6}$$

As a reference, the open-ear response to the noise can be defined as:

$$\left.\frac{e}{n}\right|_{open}\equiv G_{en}\Big|_{O} \tag{7}$$

The total performance of the ANR device (e.g., an ANR headphone) can be expressed in terms of a target Insertion Gain (IG), which is the ratio of: (i) the noise at the ear relative to the noise when the device is active and being worn by a user, and (ii) the reference open-ear response. This is given by:

$$IG=PIG\left[1+G_{ed}\frac{\left(\frac{G_{sn}}{G_{en}}\right)K_{fb}+\left(\frac{G_{on}}{G_{en}}\right)K_{ff}}{1-K_{fb}G_{sd}}\right] \tag{8}$$

where the passive insertion gain (PIG) is defined as the purely passive response of the ANR device when it is worn by the user. The PIG is given by:

$$PIG\equiv\frac{G_{en}}{G_{en}\,|_{O}} \tag{9}$$

In some implementations, where the noise is measured at a point with an omni-directional reference microphone, the expressions in equations (8) and (9) may be evaluated as energy ratios (e.g., without considering the phase) measured at the ear microphone before and after the user wearing the ANR device, with the ANR device in either active or passive mode, respectively.

In some implementations, the various noise disturbance terms may be expressed as normalized cross spectra between the available microphones as:

$$N_{so}\equiv\frac{G_{sn}}{G_{on}},\ N_{co}\equiv\frac{G_{en}}{G_{on}},\ N_{es}\equiv\frac{G_{en}}{G_{sn}} \tag{10}$$

Using these expressions, equation (8) may be rewritten as:

$$IG=PIG\left[1+\left(\frac{G_{ed}}{N_{eo}}\right)\frac{N_{so}K_{fb}+K_{ff}}{1-K_{fb}G_{sd}}\right] \tag{11}$$

Equation (11) relates the total insertion gain (which may be referred to as the target insertion gain) of an ANR device to the measured acoustics of the system, and the associated feedback compensator 112 and feedforward compensator 116, $K_{fb}$ and $K_{ff}$, respectively. In some implementations, for a given fixed feedback compensator 116, equation (11) may therefore be used to compute corresponding feedforward compensators 112 for specified values of target insertion gains and the other parameters. For example, the target insertion gain can be set to 0 to obtain a feedforward compensator 112 configured to provide full ANR (maximum noise cancellation) for the given device. Such a filter or feedforward compensator may be denoted as $K_{ANR}$. Conversely, the target insertion gain can be set to 1 to obtain a feedforward compensator 112 that passes the signals captured by the feedforward microphone 102 with unity gain. Such a filter or feedforward compensator is referred to herein as an "aware mode" or "pass-through" filter, and is denoted as $K_{Aware}$.

Figure 3A:
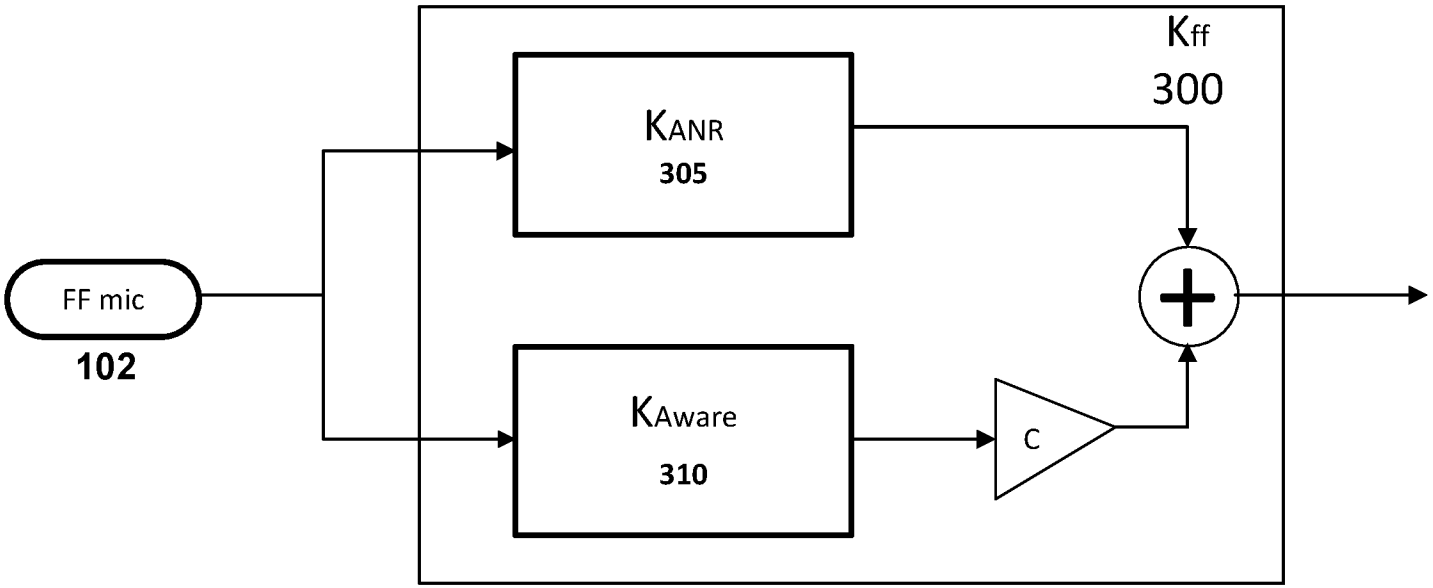
FIG. 3A is a block diagram of a feedforward compensator having an ANR signal flow path disposed in parallel to a pass-through signal flow path.

In some implementations, to allow for intermediate target insertion gains between 0 and 1, and allow a user to control the amount of ambient noise passed through the device, the two filters $K_{ANR}$ and $K_{Aware}$ can be disposed in parallel in the feedforward signal flow path, as shown in FIG. 3A. The example configuration of FIG. 3A shows a feedforward compensator 300 where an ANR filter 305 and a pass-through filter 310 are disposed in parallel, with the gain of the pass-through filter being adjustable by a factor C. The adjustable gain C may be implemented using a variable gain amplifier (VGA) disposed in the pass-through signal flow path of the feedforward compensator 300. The overall transfer function of the feedforward compensator 300 may be represented as:

$$K_{ff}=K_{ANR}+CK_{Aware} \tag{12}$$

The parallel structure of the ANR filter and the pass-through filter may be implemented in various ways. In some implementations, each of the ANR filter and the pass-through filter can be substantially fixed, and the adjustable factor can be based on user-input indicative of an amount of ambient noise and sounds that the user intends to hear. This may represent an efficient and low complexity implementation, particularly for applications where the contribution of one of the signal flow paths (the ANR signal flow path or the pass-through signal flow path) is expected to dominate the final output. This can happen, for example, when the value of C is expected to be close to either 0 or 1. In such cases, the magnitude responses of the individual paths may not deviate significantly from corresponding design values. For example, the magnitude response of each of the ANR signal flow path and the pass-through signal flow path may be designed in accordance with a set of target spectral characteristics (e.g., spectral flatness), and when one of the paths dominate the output, the paths may not deviate significantly from the corresponding target flatness.

In some implementations, when the individual gains of the ANR path and the pass-through path approach one another, the phase responses of the individual paths may interfere constructively or destructively, thereby potentially making the corresponding magnitude responses deviate significantly from the design values. For example, the interference of the phase responses of the two paths may, in some cases, degrade the target flatness of the corresponding magnitude responses. This in turn may degrade the performance of the ANR device.

In some implementations, the effect of interference between the phase responses of the two paths may be mitigated by using a filter bank in at least one of the two signal flow paths disposed in parallel. For example, the ANR filter 305 can include a filter bank that includes a plurality of selectable digital filters, wherein each digital filter in the filter bank corresponds to a particular value of C. In some implementations, the pass-through filter 310 may include a similar filter bank. In such cases, a change in the value of C can prompt a change in one or more of the ANR filter 305 and the pass-through filter 310. The filters can be selected (or computed in real time based on the value of C), for example, such that any interference between the resulting phase responses do not degrade the spectral characteristics (e.g., flatness) of the magnitude response beyond a target tolerance limit.

In some implementations, instead of obtaining a $K_{ANR}$ and a $K_{Aware}$ separately for two different values of insertion gain, and adding the two filters together, the insertion gain can be kept as a free parameter to obtain two separate filters that are independent of any particular insertion gain. For example, solving for $K_{ff}$ using equation (11) yields:

$$K_{ff} = -\left[K_{fb}N_{so} + (1 - K_{fb}G_{sd})\left(\frac{N_{eo}}{G_{ed}}\right)\right] + IG\left[\frac{1 - K_{fb}G_{sd}}{PIG}\left(\frac{N_{eo}}{G_{ed}}\right)\right] \quad (13)$$

which may be represented as:

$$K_{ff} = K_{nc} + IG\,K_{aw} \quad (14)$$

Figure 3B:
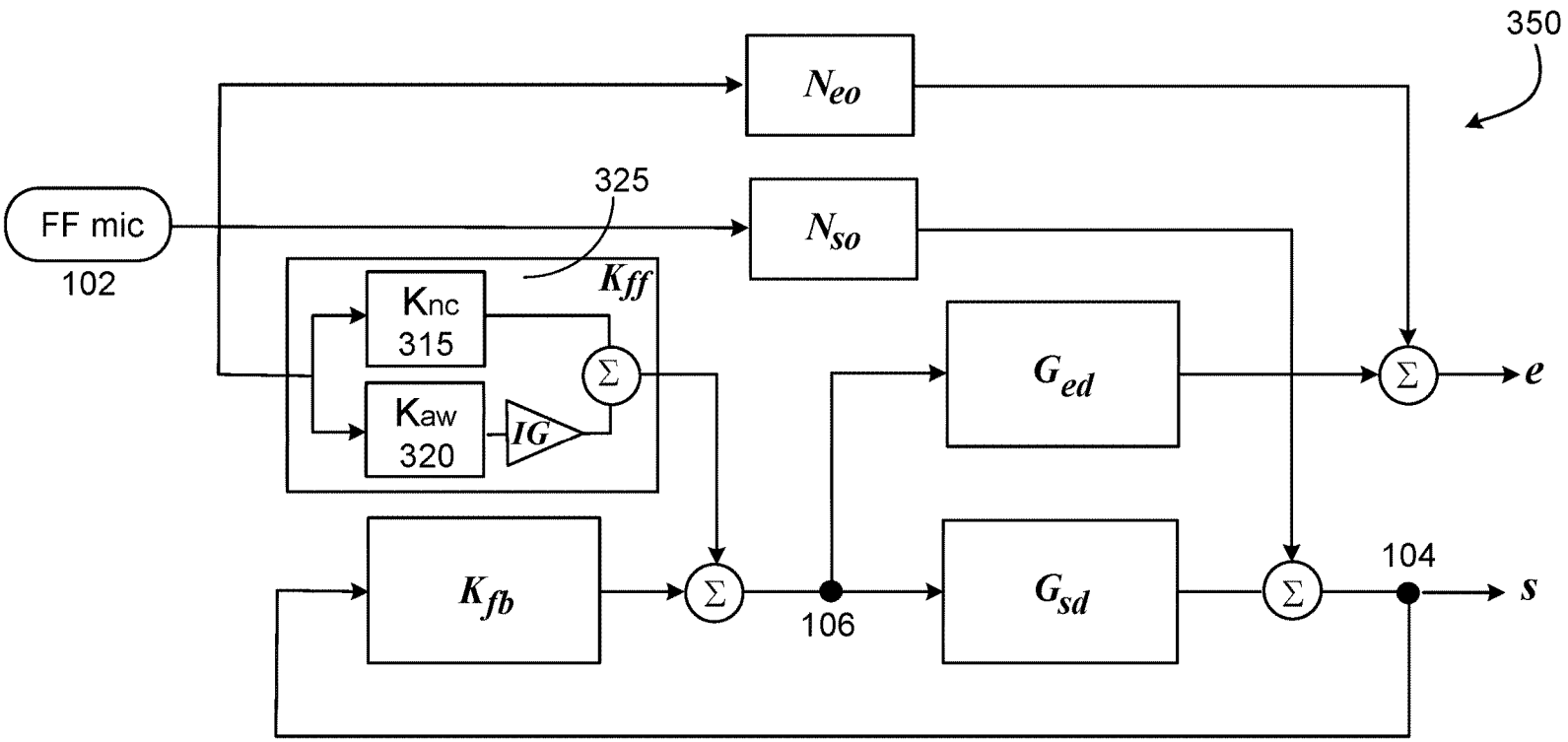
FIG. 3B is a block diagram of an example configuration of an ANR device having an ANR signal flow path disposed in parallel to a pass-through signal flow path in the feedforward path.

In equation (14), $K_{nc}$ equals the first term in the right hand side of equation (13), and represents a noise cancellation filter. $K_{aw}$ equals the second term in the right hand side of equation (13) and represents a pass-through filter. FIG. 3B is a block diagram of an example configuration 350 of an ANR device that includes an ANR signal flow path disposed in parallel to a pass-through signal flow path in accordance with equation (14) within a feedforward compensator 325. Specifically, the ANR signal flow path includes the ANR filter 315 and the pass-through signal flow path includes the pass-through filter 320, wherein the filters 315 and 320 are obtained in accordance with equations (13) and (14). The transfer functions $N_{eo}$ and $N_{so}$ are defined above in equation (10).

In some implementations, the feedforward compensator 325 shown in FIG. 3B may provide one or more advantages. For example, because the filters 315 and 320 can be implemented as fixed coefficient filters, the need for any filter bank may be obviated. This in turn may allow for the feedforward compensator 325 to be implemented using lower processing power and/or storage requirements. This may be particularly advantageous in smaller form-factor ANR devices that have limited processing power and/or storage space on-board. Further, because the phase responses of the two parallel paths are not dependent on the insertion gain, the magnitude responses may remain substantially invariant to the insertion gain IG. For example, the insertion gain may not significantly affect the flatness or other spectral characteristics of the magnitude responses associated with the two parallel paths when the insertion gains are varied over a range. In some implementations, the feedforward compensator can be configured to support arbitrary values of the insertion gain IG, including for example, values large than unity that can be used to amplify the ambient sounds. This can be useful, for example, in devices such as hearing aids, and/or to hear ambient sounds that may not be otherwise audible. For example, in order to better hear audio emanating from a distant source, a user may temporarily turn up the gain such that the IG value is more than unity.

Figure 4:
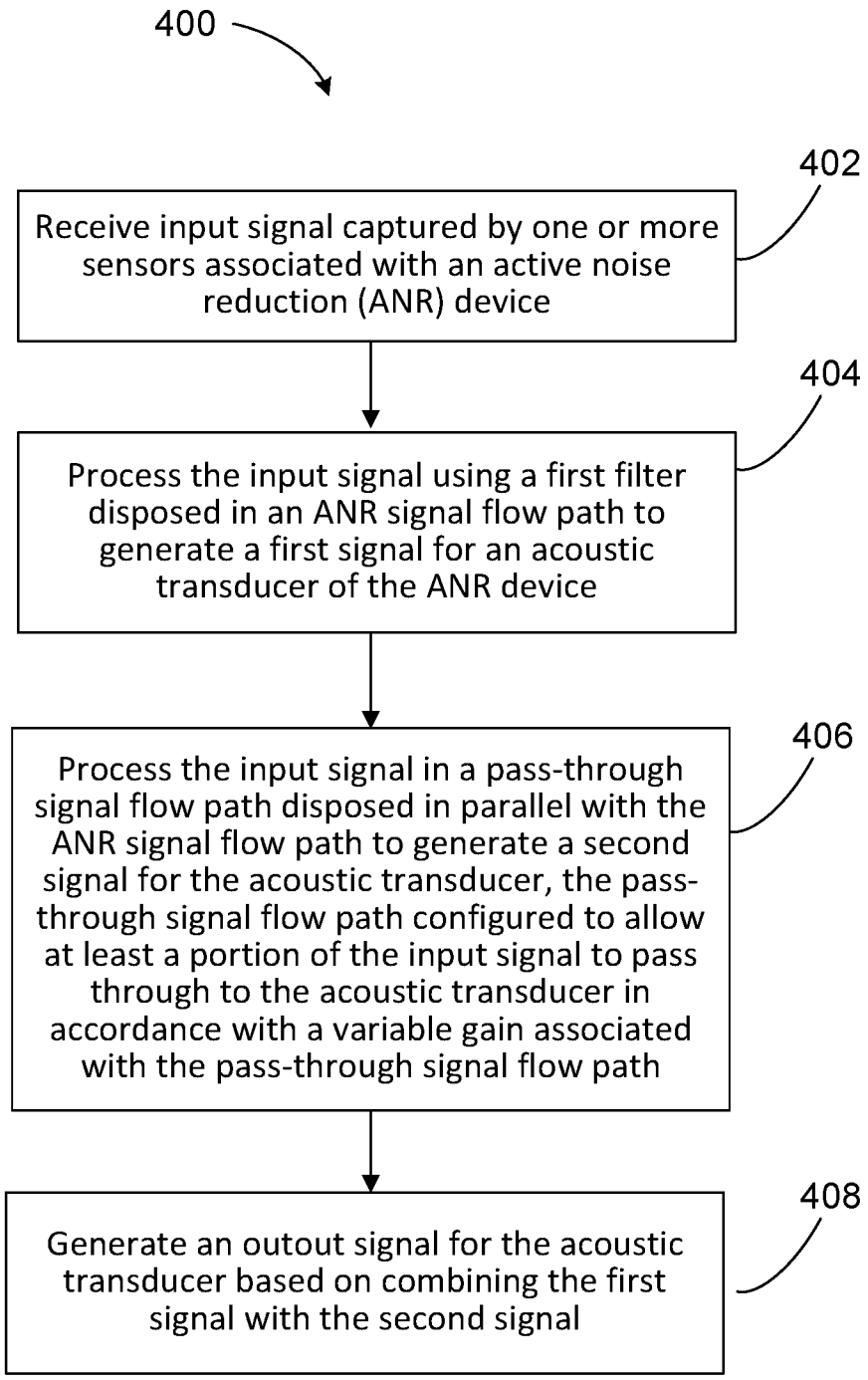
FIG. 4 is a flowchart of an example process for generating an output signal in an ANR device that includes an ANR signal flow path and a pass-through signal flow path disposed in parallel.

FIG. 4 is a flowchart of an example process 400 for generating an output signal in an ANR device that includes an ANR signal flow path and a pass-through signal flow path disposed in parallel. At least a portion of the process 400 can be implemented using one or more processing devices such as DSPs described in U.S. Pat. Nos. 8,073,150 and 8,073,151, incorporated herein by reference in their entirety. Operations of the process 400 include receiving an input signal captured using one or more sensors associated with an ANR device (402). In some implementations, the one or more sensors include a feedforward microphone of an ANR device such as an ANR headphone. In some implementations, the ANR device can be an in-ear headphone such as one described with reference to FIG. 1. In some implementations, the ANR device can include, for example, around-the-ear headphones, over-the-ear headphones, open headphones, hearing aids, or other personal acoustic devices. In some implementations, the feedforward microphone can be a part of an array of microphones.

Operations of the process 400 also include processing the input signal using a first filter disposed in an ANR signal flow path to generate a first signal for an acoustic transducer of the ANR device (404). The ANR signal flow path can be disposed in a feedforward signal flow path of the ANR device, the feedforward signal flow path being disposed between a feedforward microphone and an acoustic transducer of the ANR device. In some implementations, the first filter can be substantially similar to the ANR filters 305 and 315 described above with reference to FIGS. 3A and 3B, respectively. In some implementations, the first signal can include an anti-noise signal generated in response to a noise detected by a feedforward microphone, wherein the anti-noise signal is configured to cancel or at least reduce the effect of the noise. In some implementations, the first filter can be a fixed-coefficient filter. In some implementations, the first filter may be provided as a filter bank that includes a plurality of selectable digital filters, each digital filter in the filter bank corresponding to a value of a variable gain associated with a pass-through signal flow path disposed in parallel to the ANR signal flow path.

Operations of the process 400 further include processing the input signal in the pass-through signal flow path to generate a second signal for the acoustic transducer, wherein the pass-through signal flow path is configured to allow at least a portion of the input signal to pass through to the acoustic transducer in accordance with the variable gain (406). The pass-through signal flow path can include a second digital filter. The second digital filter can be substantially similar to the pass-through filter 310 and 320 described above with reference to FIGS. 3A and 3B, respectively. In some implementations, the second filter may be implemented as a fixed-coefficient filter. In some implementations, the coefficients of the second filter may be determined substantially independently of a set of coefficients of the first filter. For example, both the first and second filter may be determined independently using equation (11), but with different values of insertion gain. In some implementations, the second filter may be provided as a bank of selectable filters.

In some implementations, pass through signal path can include a VGA, which may be adjusted in accordance with one or more user-inputs indicative of an adjustable gain associated with the pass-through signal path. In some implementations, coefficients of at least one of the first filter and the second filter are determined in accordance with the one or more user-inputs indicative of the gain associated with the pass-through signal path.

In some implementations, the coefficients of the at least one of the first filter and the second filter are determined in accordance with a target spectral characteristic of the corresponding filter. In some implementations, the target spectral characteristic can be spectral flatness. For example, the filters 315 and 320 described above with reference to FIG. 3B may be designed in accordance with target spectral flatness of the corresponding filters. In some implementations, the first filter and the second filter may be implemented using two different processing devices running at different speeds. In such cases, the latencies associated with the two filters can be substantially different from one another. For example, the latency associated with the first filter can be 15-20 μs, whereas the latency associated with the second filter is 5 ms. If the two filters are independently determined (e.g., as in the configuration of FIG. 3A), a large latency difference between the filters can cause the overall magnitude response of the feedforward compensator to deviate significantly from the target flatness. In some implementations, where the latency difference is large, using the gain-agnostic feedforward compensator of FIG. 3B may be advantageous in maintaining a target spectral flatness of the feedforward compensator.

The operations of the process 400 also includes generating an output signal for the acoustic transducer based on combining the first signal and the second signal (408). In some implementations, the output signal may be combined with one or more additional signals (e.g., a signal produced by a feedback compensator of an ANR device, a signal produced in an audio path of the ANR device, etc.) before being provided to the acoustic transducer. The audio output of the acoustic transducer may therefore represent a noise-reduced audio combined with audio representing the ambience as adjusted in accordance with user-preference.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). In some implementations, at least a portion of the functions may also be executed on a floating point or fixed point digital signal processor (DSP) such as the Super Harvard Architecture Single-Chip Computer (SHARC) developed by Analog Devices Inc.

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Other embodiments and applications not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. A method comprising:

receiving an input signal captured by one or more sensors associated with an active noise reduction (ANR) device;

processing the input signal using a first filter disposed in an ANR signal flow path to generate a first signal for an acoustic transducer of the ANR device;

processing the input signal in a pass-through signal flow path disposed in parallel with the ANR signal flow path to generate a second signal for the acoustic transducer, wherein the pass-through signal flow path is configured to allow at least a portion of the input signal to pass through to the acoustic transducer in accordance with a variable gain associated with the pass-through signal flow path; and generating an output signal for the acoustic transducer based on combining the first signal with the second signal.

2. The method of claim 1, wherein the one or more sensors comprise a feedforward microphone of the ANR device.

3. The method of claim 1, wherein the first filter comprises a filter bank that includes a plurality of selectable digital filters, each digital filter in the filter bank corresponding to a value of the variable gain associated with the pass-through signal flow path.

4. The method of claim 1, wherein the pass-through signal flow path comprises a second filter.

5. The method of claim 4, wherein coefficients of each of the first filter and the second filter are substantially fixed.

6. The method of claim 4, wherein a set of coefficients of the first filter is determined substantially independently of a set of coefficients of the second filter.

7. The method of claim 1, wherein a first latency associated with the ANR signal flow path is substantially different from a second latency associated with the pass-through signal flow path.

8. The method of claim 1, further comprising:

receiving a user-input indicative of the variable gain associated with the pass-through signal path; and adjusting a variable gain amplifier (VGA) disposed in the pass-through signal flow path in accordance with the user-input.

9. The method of claim 1, further comprising:

receiving a user-input indicative of the variable gain associated with the pass-through signal flow path; and selecting coefficients of at least one of the first filter and a second filter disposed in the pass-through signal flow path in accordance with the user-input.

10. The method of claim 9, wherein the coefficients of the at least one of the first filter and the second filter are determined in accordance with a target spectral characteristic of the corresponding filter.

11. The method of claim 10, wherein the target spectral characteristic is spectral flatness.

12. The method of claim 1, wherein the ANR signal flow path and pass-through signal flow path are disposed in a feedforward signal flow path for the ANR device.

13. An active noise reduction (ANR) device comprising:

one or more sensors configured to generate an input signal indicative of an external environment of the ANR device;

an acoustic transducer configured to generate output audio;

a first filter disposed in an ANR signal flow path of the ANR device, the first filter configured to process the input signal to generate a first signal for the acoustic transducer of the ANR device; and a pass-through signal flow path disposed in parallel with the ANR signal flow path, the pass-through signal flow path configured to generate a second signal for the acoustic transducer, wherein the pass-through signal flow path is configured to allow at least a portion of the input signal to pass through to the acoustic transducer in accordance with a variable gain associated with the pass-through signal flow path, wherein the acoustic transducer is driven by an output signal that is a combination of the first signal and the second signal.

14. The ANR device of claim 13, wherein the one or more sensors comprise a feedforward microphone of the ANR device.

15. The ANR device of claim 13, wherein the ANR filter comprises a filter bank that includes a plurality of selectable digital filters, each digital filter in the filter bank corresponding to a value of the variable gain associated with the pass-through signal flow path.

16. The ANR device of claim 13, wherein the pass-through signal flow path comprises a second filter.

17. The ANR device of claim 16, wherein coefficients of each of the first filter and the second filter are substantially fixed.

18. The ANR device of claim 16, wherein a set of coefficients of the first filter is determined substantially independently of a set of coefficients of the second filter.

19. The ANR device of claim 13, wherein a first latency associated with the ANR signal flow path is substantially different from a second latency associated with the pass-through signal flow path.

20. The ANR device of claim 13, further comprising a variable gain amplifier (VGA) disposed in the pass-through signal flow path, the VGA configured to control the variable gain associated with the pass-through signal flow path in accordance with user-input received using an input device.

21. The ANR device of claim 20, further comprising one or more processing devices configured to select coefficients of at least one of the first filter and a second filter disposed in the pass-through signal flow path in accordance with the user-input.

22. The ANR device of claim 21, wherein the coefficients of the at least one of the first filter and the second filter are determined in accordance with a target spectral characteristic of the corresponding filter.

23. The ANR device of claim 22, wherein the target spectral characteristic is spectral flatness.

24. The ANR device of claim 13, wherein the ANR signal flow path and pass-through signal flow path are disposed in a feedforward signal flow path for the ANR device.

25. One or more machine-readable storage devices having encoded thereon computer readable instructions for causing one or more processing devices to perform operations comprising:

receiving an input signal captured by one or more sensors associated with an active noise reduction (ANR) device;

processing the input signal using a first filter disposed in an ANR signal flow path to generate a first signal for an acoustic transducer of the ANR device;

processing the input signal in a pass-through signal flow path in parallel with the ANR signal flow path to generate a second signal for the acoustic transducer, wherein the pass-through signal flow path is configured to allow at least a portion of the input signal to pass through to the acoustic transducer in accordance with a variable gain associated with the pass-through signal flow path; and generating an output signal for the acoustic transducer based on combining the first signal with the second signal.

* * * * *